US009567699B2

(12) United States Patent
Elliott et al.

(10) Patent No.: US 9,567,699 B2
(45) Date of Patent: Feb. 14, 2017

(54) SWIVELING TABLET MOUNT

(71) Applicant: Gammill, Inc., West Plains, MO (US)

(72) Inventors: Daniel Lee Elliott, West Plains, MO (US); Joseph Wesley Bauman, Cabool, MO (US); John Ray Busé, Houston, MO (US)

(73) Assignee: GAMMILL, INC., West Plains, MO (US)

( * ) Notice: Subject to any disclaimer, the term of this patent is extended or adjusted under 35 U.S.C. 154(b) by 0 days.

(21) Appl. No.: 14/691,022

(22) Filed: Apr. 20, 2015

(65) Prior Publication Data

US 2015/0299923 A1 Oct. 22, 2015

Related U.S. Application Data

(60) Provisional application No. 61/981,924, filed on Apr. 21, 2014.

(51) Int. Cl.

| | |
|---|---|
| ***D05B 11/00*** | (2006.01) |
| ***D05B 19/00*** | (2006.01) |
| ***D05B 69/04*** | (2006.01) |

(52) U.S. Cl.

CPC ..... *D05B 11/00* (2013.01); *D05B 19/006* (2013.01); *D05B 69/04* (2013.01); *D05D 2205/18* (2013.01)

(58) Field of Classification Search

CPC ..... D05B 11/00; D05B 19/00–19/16; D05B 19/105; D05B 69/04; G05B 2219/2626; G05B 2219/45195; G03B 17/00; D05D 2205/18

See application file for complete search history.

(56) References Cited

U.S. PATENT DOCUMENTS

| | | | | |
|---|---|---|---|---|
| 6,209,468 | B1 | 4/2001 | Marcangelo | |
| 7,377,222 | B1 | 5/2008 | Moore | |
| 7,980,188 | B2 | 7/2011 | Shimizu | |
| 8,037,834 | B2 | 10/2011 | Shimizu | |
| 8,074,590 | B2 | 12/2011 | Bentley | |
| 8,286,568 | B2 * | 10/2012 | Tokura | D05B 19/12 112/102.5 |
| 8,511,629 | B2 | 8/2013 | Sullivan | |
| 8,528,491 | B2 | 9/2013 | Bentley | |
| 2007/0204781 | A1 * | 9/2007 | Noguchi | D05B 19/08 112/470.06 |
| 2009/0195649 | A1 * | 8/2009 | Gylling | D05B 11/00 348/125 |
| 2011/0101058 | A1 * | 5/2011 | Heckman | B64D 45/00 224/401 |
| 2013/0190916 | A1 | 7/2013 | Schnaufer | |

(Continued)

FOREIGN PATENT DOCUMENTS

JP 2015223412 A * 12/2015

*Primary Examiner* — Ismael Izaguirre

(74) *Attorney, Agent, or Firm* — Husch Blackwell LLP

(57) ABSTRACT

The present invention relates to a quilting machine, or stitcher, further including a centrally located swiveling tablet mount for securing a tablet that is used in the quilting process. The mount is positioned such that a user may access the mount from either side of, or the rear or front of the stitcher. The mount is one capable of swiveling so that the user does not have to move the tablet between front and rear mounts of the stitcher or buy separate tablets for a front and rear mount.

17 Claims, 4 Drawing Sheets

(56) References Cited

U.S. PATENT DOCUMENTS

| | | | | |
|---|---|---|---|---|
| 2013/0193290 | A1* | 8/2013 | Lohmann | B60R 11/0252 248/276.1 |
| 2013/0249227 | A1* | 9/2013 | Lin | F16M 13/06 294/142 |
| 2014/0124644 | A1* | 5/2014 | Wong | E05B 73/0082 248/553 |
| 2014/0263884 | A1* | 9/2014 | Grziwok | F16M 11/06 248/176.3 |

* cited by examiner

SWIVELING TABLET MOUNT

CROSS-REFERENCE TO RELATED APPLICATION

This application claims priority and benefit of U.S. Provisional Patent Application 61/981,924 filed Apr. 21, 2014 entitled SWIVELING TABLET MOUNT, and is hereby incorporated by reference in its entirety.

BACKGROUND OF INVENTION

The present invention relates to sewing. In particular, the invention relates to particular styles of sewing that incorporate decorative stitching such as quilting. A quilt is a type of blanket typically having three layers: a decorative top layer, a middle layer of insulating material, and a backing layer. "Quilting" refers to the technique of joining these layers by stitches or ties.

Traditional quilting was done by hand and was very labor intensive. The invention of the sewing machine changed that. Quilting evolved from production of functional blankets by specialized artisans into a popular hobby enjoyed by many.

Modern quilts are typically made using a long-armed sewing machine, or stitcher, attached to a frame. The frame supports and holds the workpiece in place while the sewing machine moves along the frame with respect to the workpiece. A typical quilting apparatus illustrating the relationship between the workpiece, frame, and sewing machine is shown in U.S. Pat. Pub. No. 2013/0190916.

A common way to quilt today is to use what is known as pantograph patterns. Pantographs are a way to "trace" a pre-printed stitch pattern with the machine in order to stitch that pattern onto the fabric. This allows very consistent work to be completed with a much lower skill level required versus traditional hand-guided stitching alone.

Such a method is normally accomplished by mounting a paper pattern on the rear of the table. A laser pointer is mounted to the stitcher head. The operator sets up the needle/thread at the front of the machine, and then uses handles provided at the rear of the machine head to control the head during stitching from the rear of the table. By "tracing" the paper pattern with the laser dot, the operator is able to reproduce the patterns from the paper template to the fabric being sewn. A user interface such as a tablet computer may be used to control certain aspects of the stitcher, for example controlling whether a needle is in the "up" or "down" position, stitching mode, etc.

While the normal user location is at the front of the machine, an additional user interface is sometimes needed at the rear as well when a quilter is quilting using the pantograph method. For some systems, this is accomplished by placing two, redundant user interface devices at the front and rear of the machine. Some systems accomplish this by making the front user interface device removable with a mount or dock at the rear of the machine.

Placing two redundant user interfaces at both the front and rear of the machine can generate extra, unnecessary expense. Both the user interfaces and the mounts used to hold them can be quite expensive. In the scenario where a user must remove and mount the user interface back and forth between the front and rear of the machine, an operator wastes time and effort.

SUMMARY OF INVENTION

The present invention relates to a quilting machine, more specifically a long-armed stitching machine, or stitcher. The stitcher may include a sewing head that includes the sewing machine used to quilt fabric. The fabric may be stretched between two rollers of a frame below the stitcher. Typically, an operator can use handles at the front of the stitcher to guide the stitcher above the fabric to cause the needle and thread associated with the stitcher to stitch in a desired pattern. Alternatively, an operator at the rear portion of the stitcher may steer the head using handles such that a downwardly pointing laser associated with the head traces a pantograph pattern located in front of and below the fabric. By tracing the pantograph pattern with the laser, the operator may ensure that the needle and thread at the front portion of the head produces the same pattern that is in front of and below the fabric.

The stitcher head of the present invention may also include a swiveling tablet mount positioned and located on top of the sewing machine head. The tablet mount may be placed at a side portion of the stitcher head in alternative embodiments. In the preferred embodiment, the tablet mount is centrally-mounted such that it may be accessed from the front, side, or rear of the stitcher head in both of the aforementioned quilting methods. The tablet mount is configured to securely receive and secure a user interface device such as a tablet computer.

The mount may include flanges extending from each of its sides, as well as from its top or bottom that are preferably positioned and located to receive and secure a tablet. The mount may further be secured to a mounting adapter, or block. The mounting adapter may include a central shaft or mounting post that is housed with, and extends through, the mounting adapter. This shaft may act as a pivot about which the mounting adapter may rotate. The shaft preferably has a cut ramping profile that includes valleys at various possible user locations.

The mounting adapter further may include a pin that may engage any of the valleys positioned and located at the various possible user locations. A spring may be used to provide a downward force on the mounting adapter to assure that the pin of the mounting adapter engages with a valley of the central shaft. Thus, the mounting adapter and consequently the mount, are preferably only capable of stopping at the various possible user locations. This further may assure that there is not unnecessary movement of the tablet due to vibrations and other movements associated with operating the stitcher.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
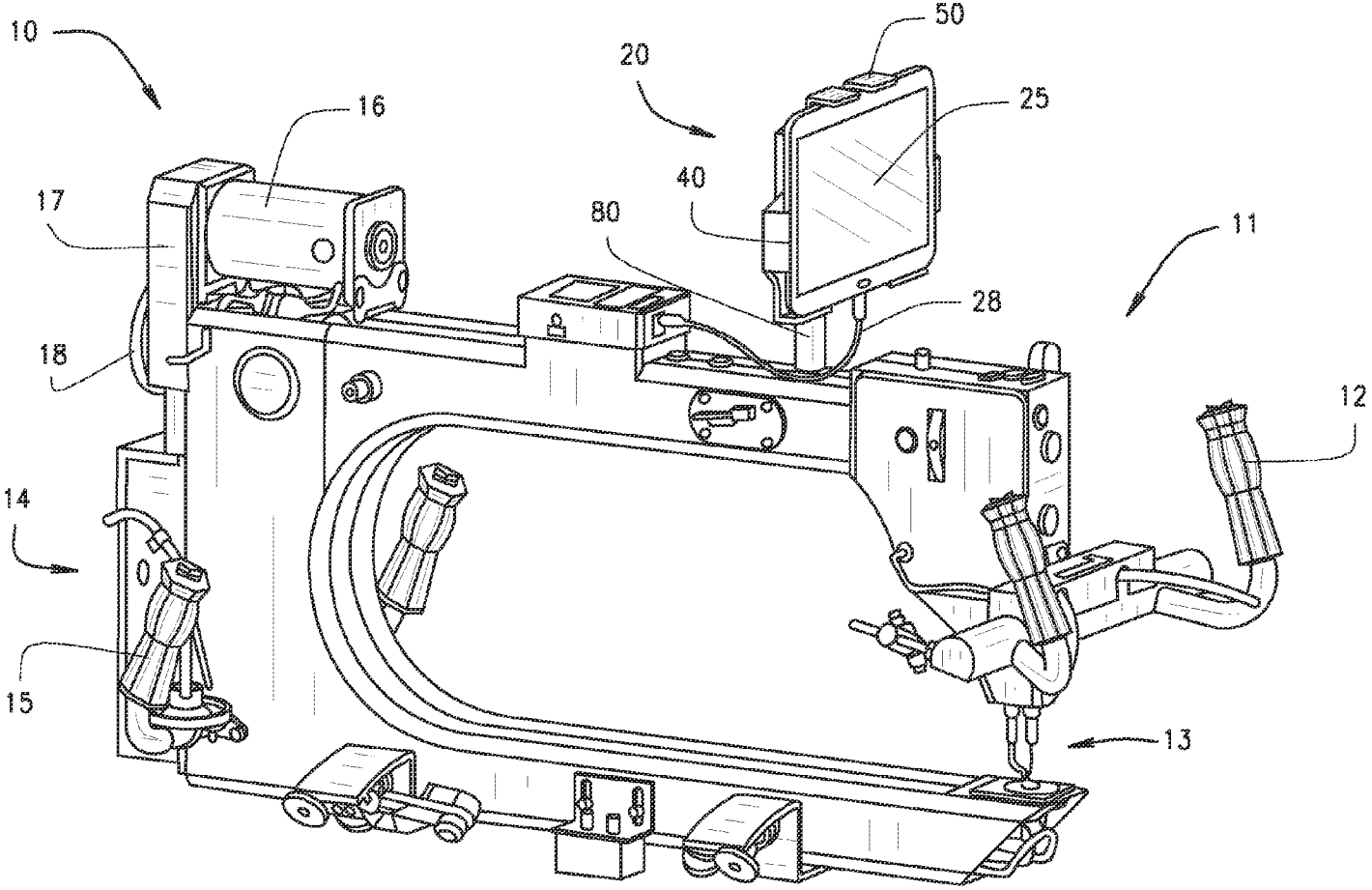
FIG. 1 is a perspective view of a sewing machine head of a long-armed sewing machine including a centrally mounted swiveling tablet mount and tablet contained therein.

The present invention is directed generally toward a sewing machine further preferably including a centrally mounted swiveling tablet mount for use therewith. FIG. 1 is a perspective view of a sewing machine head 10 for use with a long-armed sewing machine, or long-armed stitcher. Various components of sewing machine head 10 are known in the art for use with a long-armed stitcher. Sewing machine head 10 may include a front portion 11 where a first set of handles 12 are preferably positioned and located for moving the sewing machine head 10 above a quilt such that needle and thread apparatus 13 may stitch a desired pantograph pattern in the quilt positioned and located below the sewing machine head 10 in a long-armed stitcher arrangement known in the art.

At rear portion 14 of the sewing machine head 10, the sewing machine head further preferably comprises a second set of handles 15 that are positioned and located for moving the sewing machine head 10 in order to trace a pantograph pattern positioned below the sewing machine head 10, thus ensuring that the needle and thread 13 located at the front portion 11 of the sewing machine head 10 reproduces the pantograph pattern. The pantograph pattern may be traced by means of a laser mounted to the rear portion 14 of the sewing machine head 10, for example to handles 15. Alternatively, it may be traced by a physical pointer, such as a rod or wire member, that is mounted in a similar manner. In yet another alternative embodiment, the pantograph pattern may be traced on a computer device or otherwise digitally traced.

The sewing machine head 10 preferably comprises a plurality of components known in the art. FIG. 1 illustrates a motor 16, belt guard 17, and rear hand wheel 18. Other components known in the art that are commonly included in a sewing machine head 10 may also be included with sewing machine head 10. For example, sewing machine head 10 may include cone holders, thread guides, and other known components in its various embodiments.

FIG. 1 further illustrates a centrally mounted swiveling tablet mount 20 for use with sewing machine head 10. The swiveling tablet mount 20 may be used to releasably secure a tablet 25, like the tablet illustrated in FIG. 1. The tablet 25 is shown as a Samsung Galaxy Tab 3 10.1 Android tablet in the illustrated embodiment. Yet, other embodiments are envisioned where an iPad or other tablet or electronic device may be used instead. The swiveling tablet mount 20 may be adapted to receive any display device that includes a user interface that may be programmable to control functional aspects of a sewing machine.

An electronic medium such as cord 28 may be used to supply power to the tablet 25 and the various electronic components contained within sewing machine head 10. The sewing machine and tablet 25 communicate with one another via a Bluetooth connection in one embodiment, though other means of communication also are foreseen. By way of the Bluetooth connection, tablet 25 may be used to control various functions of sewing machine head 10 including stitch mode, stitch speed, etc. Swiveling tablet mount 20 is preferably positioned and located at a central portion of sewing machine head 10 such that it may be accessed and visible from the front portion 11 or rear portion 14 of sewing machine head 10, as well as from either side of the sewing machine head 10. The manner by which swiveling tablet mount 20 may rotate to be accessible from front and rear portions 11, 14 is discussed herein below after describing the manner in which swiveling tablet mount 20 is constructed.

Figure 2:
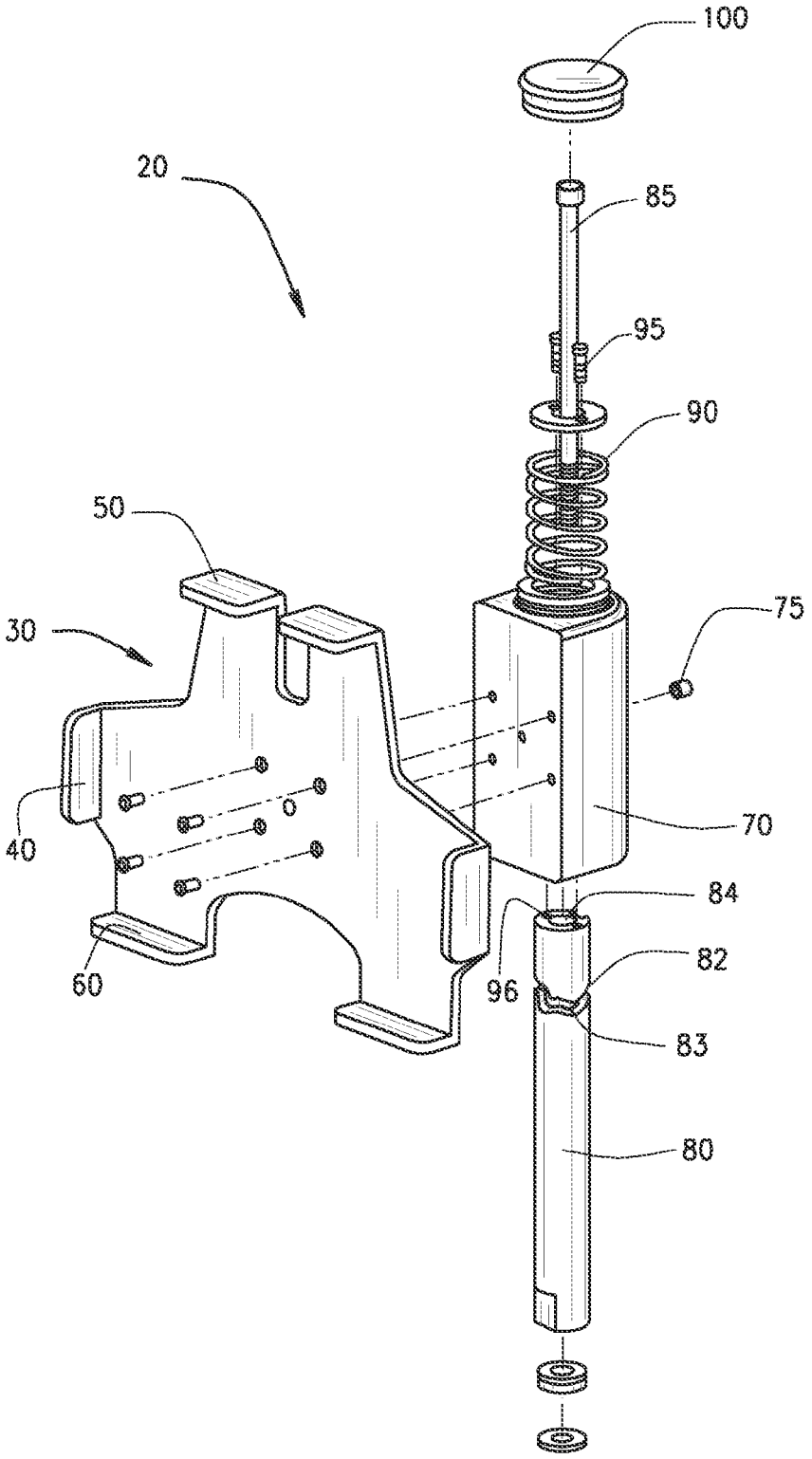
FIG. 2 is an exploded perspective view of the swiveling tablet mount of FIG. 1.

FIG. 2 illustrates an exploded perspective view of swiveling tablet mount 20 and the components contained therein. A tablet holder 30 is preferably sized such that it can receive and engage a tablet such as tablet 25. In the illustrated embodiment of FIG. 2, the tablet holder 30 is sized and positioned to receive a Samsung Galaxy Tab 3 10.1 Android tablet, though other sizes and positions are further envisioned. The illustrated tablet holder 30 preferably includes latitudinal flange portions 40 extending outwardly from the side portions of the tablet holder 30 for securing a tablet therein. Longitudinal flange portions 50 and 60, preferably extend outwardly from the upper and lower portions of tablet holder 30, respectively, to further secure a tablet within tablet holder 30.

Tablet holder 30 may be secured at its rear portion to a mounting adapter 70. The mounting adapter 70 is preferably secured to the tablet holder 30 by a plurality of screws in the illustrated embodiment, though other attachment means known in the art are further envisioned. A pin 72 (illustrated in FIGS. 4 and 5) is preferably positioned and located in a central portion of the mounting adapter 70, and it preferably extends inwardly into the mounting adapter, but may not extend all the way therethrough to the rear portion of the mounting adapter 70. A nylon roller 75 is shown removed from the mounting adapter 70. In operation, the nylon roller 75 may be removably attached to an end portion of the pin 75 within the mounting adapter 70.

A central shaft 80 may be seen below the mounting adapter 70. The central shaft 80 may be cooperatively engaged with sewing machine head 10 at its lower portion; this engagement may be spaced by washers or other means known of foreseeable in the art. Central shaft 80 may further be cooperatively engaged with a lower portion (illustrated in FIG. 4) of mounting adapter 70 at its upper portion in a process described in greater detail herein below. It is this latter engagement that allows the mounting adapter 70, and consequently tablet holder 30 and tablet 25 (not illustrated in FIG. 2) to swivel about the central shaft 80. The central shaft 80 preferably includes a cut ramping profile 82 which includes valleys 83 associated with the pin 72 and its nylon roller 75 when the central shaft 80 and mounting adapter 70 are cooperatively engaged. The pin 72 preferably rides within the cut ramping profile 82 when the central shaft 80 and mounting adapter 70 are cooperatively engaged in a process described in greater detail below.

Mounting adapter 70 may receive at its upper portion an attachment member 85 when the swiveling tablet mount 20 is assembled. In the illustrated embodiment, the attachment member 85 is a screw-like member including a threaded portion but may be any suitable member known or foreseeable in the art for attachment with mounting adapter 70. The attachment member 85 may extend through a spring 90. The spring 90 is preferably received by and contained within an upper portion (illustrated in FIG. 4) of the mounting adapter 70 when the swiveling tablet mount 20 is assembled. Screws 95 preferably hold a washer in place that may cause a downward force to be applied to spring 90 and thus to be applied to mounting adapter 70 such that pin 72 is forced toward valleys 83 in a process described in greater detail herein below. A plug 100 may be used to cap the upper portion of mounting adapter 70 and contain the attachment member 85 and spring 90 therein.

Figure 3:
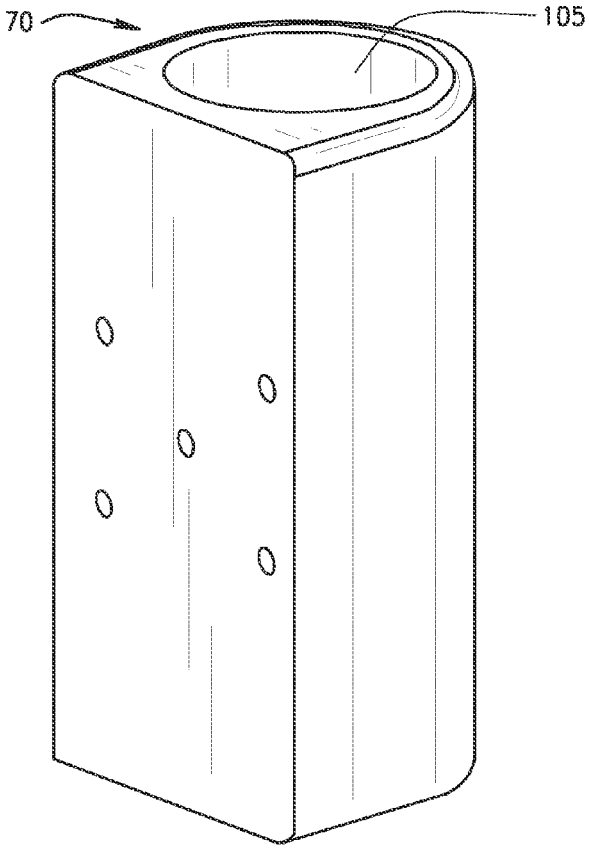
FIG. 3 is a perspective view of the mounting adapter of FIG. 2.
Figure 4:
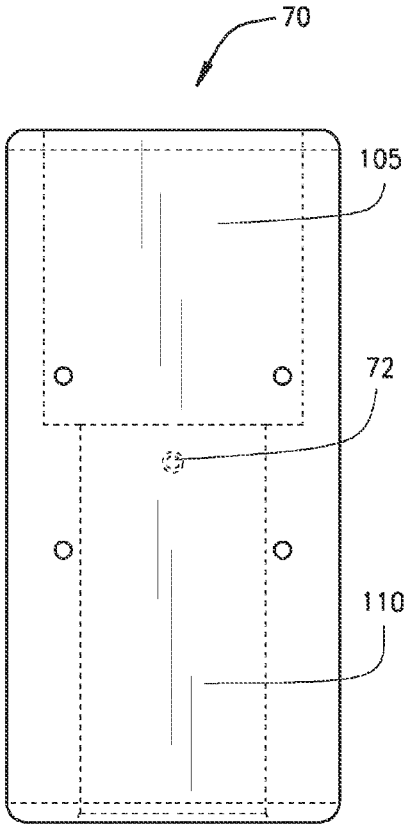
FIG. 4 is a front elevation view of a cross-section of the mounting adapter of FIG. 3.
Figure 5:
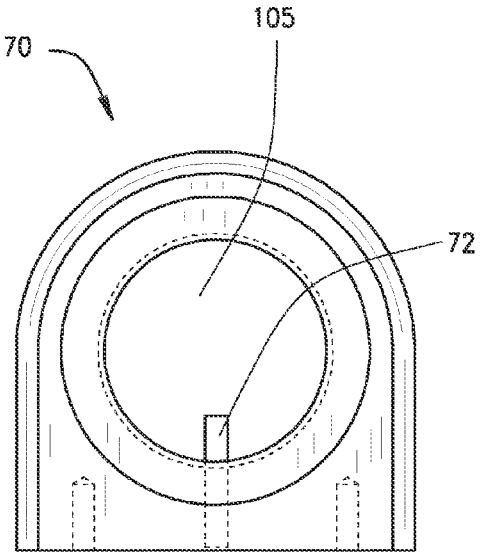
FIG. 5 is a top plan view of a cross-section of the mounting adapter of FIGS. 3 and 4.

FIGS. 3, 4, and 5 illustrate mounting adapter 70 in greater detail. Upper portion 105 is illustrated in FIG. 3, and upper portion 105 and lower portion 110 of the mounting adapter 70 is illustrated in FIG. 4. As previously described, when the swiveling tablet mount 20 is fully constructed, the central shaft 80 and its associated components may be contained within lower portion 110, while attachment member 85 and spring 90 may be contained within upper portion 105. A sleeve bearing (not illustrated) may also be contained within mounting adapter 70 for receiving the aforementioned components. Upper portion 105 preferably has a circumference slightly greater than plug 100, such that plug 100 may releasably be secured within upper portion 105 and secure various components therein.

Figure 6:
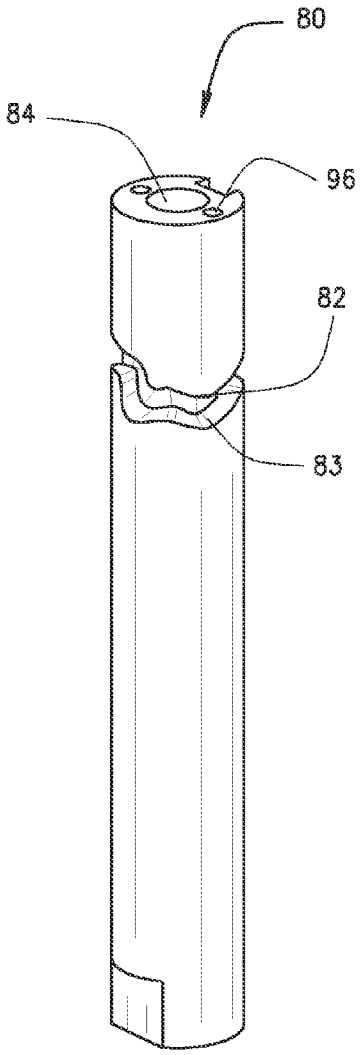
FIG. 6 is a perspective view of the central shaft of FIG. 2.

FIGS. 4 and 5 further illustrate pin 72 and the manner in which it may extend into mounting adapter 70. In doing so, when central shaft 80 (illustrated in greater detail in FIG. 6) is releasably secured within mounting adapter 70, pin 72 is positioned and located to be received by and within cut ramping profile 82. In this configuration, mounting adapter 70 may be swiveled about central shaft 80 by pin 72 being circumferentially contained but mobile within cut ramping profile 82. Valleys 83 are preferably positioned at the various positions and/or locations where a user may access the tablet associated with swiveling tablet mount 20. When spring 90 is exerting its downward force on mounting adapter 70, the pin 72 also preferably has a downward force applied thereto, thus influencing the pin 72 to "auto-locate" to the valleys 83. Therefore, the mounting adapter 70 is preferentially guided to positions where users would access a tablet associated therewith.

Other means of ensuring that the mounting adapter 70 may swivel about central shaft 80 and can be temporarily secured at various user locations are further envisioned. For example central shaft 80 may include apertures for selective engagement with spring-loaded detents associated with mounting adapter 70 or tablet holder 30. Other swiveling and securing methods are further envisioned, so long as the tablet associated with the swiveling tablet mount 20 may be swiveled and secured at various preferred user positions.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A swiveling tablet mount for use with a sewing machine head, the swiveling tablet mount comprising:

a tablet holder for holding a tablet device;

a mounting adapter selectively engageable with said tablet holder;

a central shaft selectively engageable with said mounting adapter and selectively engageable with said sewing machine head;

an attachment member selectively engageable with said mounting adapter; and wherein the swiveling tablet mount includes a spring, the attachment member extending through the spring.

2. The swiveling tablet mount of claim 1, wherein the mounting adapter includes a pin extending inwardly into the mounting adapter.

3. The swiveling tablet mount of claim 2, wherein the central shaft includes a cut ramping profile, the cut ramping profile being positioned and located for being selectively received by the pin of the mounting adapter.

4. The swiveling tablet mount of claim 1, wherein the swiveling tablet mount includes a plug for containing the attachment member and spring within the mounting adapter.

5. The swiveling tablet mount of claim 1, wherein the spring exerts a downward force that forces the pin downward into the cut ramping profile of the central shaft.

6. The swiveling tablet mount of claim 5, wherein the cut ramping profile includes a plurality of valleys for receiving the pin of the mounting adapter such that a pin auto-locates to the plurality of valleys.

7. The swiveling tablet mount of claim 1, wherein the tablet holder includes at least two longitudinal flange portions.

8. The swiveling tablet mount of claim 1, wherein the tablet holder includes at least two latitudinal flange portions.

9. A swiveling tablet mount for use with a sewing machine head, the swiveling tablet mount comprising:

a tablet holder for holding a tablet device;

a mounting adapter selectively engageable with said tablet holder, said mounting adapter comprising a pin extending inwardly therefrom;

a central shaft selectively engageable with said mounting adapter and selectively engageable with said sewing machine head, said central shaft comprising a cut ramping profile being selectively engageable with said pin of said mounting adapter;

an attachment member selectively engageable with said mounting adapter; and wherein the pin includes a nylon roller selectively engageable with the pin.

10. The swiveling tablet mount of claim 9, wherein the swiveling tablet mount includes a spring, the attachment member extending through the spring.

11. The swiveling tablet mount of claim 10, wherein the spring exerts a downward force that forces the pin downward into the cut ramping profile of the central shaft.

12. The swiveling tablet mount of claim 11, wherein the cut ramping profile includes a plurality of valleys for receiving the pin of the mounting adapter such that a pin auto-locates to the plurality of valleys.

13. The swiveling tablet mount of claim 9, wherein the swiveling tablet mount includes a plug for containing the attachment member and a spring within the mounting adapter.

14. The swiveling tablet mount of claim 9, wherein the tablet holder includes at least two longitudinal flange portions.

15. The swiveling tablet mount of claim 9, wherein the tablet holder includes at least two latitudinal flange portions.

16. A swiveling tablet mount for use with a sewing machine head, the swiveling tablet mount comprising:

a tablet holder for holding a tablet device;

a mounting adapter selectively engageable with said tablet holder, said mounting adapter comprising a pin extending inwardly therefrom;

a central shaft selectively engageable with said mounting adapter and selectively engageable with said sewing machine head, said central shaft comprising a cut ramping profile being selectively engageable with said pin of said mounting adapter; and an attachment member selectively engageable with said mounting adapter; and wherein the cut ramping profile includes a plurality of valleys.

17. The swiveling tablet mount of claim 16, wherein at least one of the plurality of valleys are located at a front portion of a stitcher, and at least one of the plurality of valleys is located at a rear portion of a stitcher.

* * * * *